US005244306A

United States Patent [19]

Artzberger

[11] Patent Number: 5,244,306

[45] Date of Patent: Sep. 14, 1993

[54] VIBRATORY COMPACTOR ATTACHMENT FOR MECHANICAL EQUIPMENT

[75] Inventor: Thomas G. Artzberger, Hartford, Wis.

[73] Assignee: M-B-W Inc., Slinger, Wis.

[21] Appl. No.: 861,200

[22] Filed: Mar. 31, 1992

[51] Int. Cl.[5] ..... E01C 19/00

[52] U.S. Cl. ..... 404/128; 37/403; 37/904

[58] Field of Search ..... 404/117, 127, 128, 132; 37/117.5, DIG. 3, DIG. 18, DIG. 12; 405/271; 172/272

[56] References Cited

U.S. PATENT DOCUMENTS

| | | | |
|---|---|---|---|
| 3,891,342 | 6/1975 | Roe | 404/128 |
| 3,963,134 | 6/1976 | Leroux | 214/145 R |
| 4,023,288 | 5/1977 | Roe | 37/117.5 |
| 4,100,688 | 7/1978 | Grist | 37/117.5 |
| 4,224,003 | 9/1980 | St. Louis | 37/DIG. 18 X |
| 4,411,081 | 10/1983 | King | 404/128 X |
| 4,732,507 | 3/1988 | Artzberger | 404/117 |
| 4,808,027 | 2/1989 | Anderson | 404/128 X |
| 4,927,289 | 5/1990 | Artzberger | 404/117 |
| 4,974,349 | 12/1990 | Timmons | 37/DIG. 18 X |
| 5,062,228 | 11/1991 | Artzberger | 37/117.5 |

FOREIGN PATENT DOCUMENTS

| | | | |
|---|---|---|---|
| 1071151 | 2/1980 | Canada | 37/117.5 |

*Primary Examiner*—William P. Neuder

*Attorney, Agent, or Firm*—Andrus, Sceales, Starke & Sawall

[57] ABSTRACT

A vibratory compactor attachment for mechanical equipment, such as an excavator or backhoe. The attachment includes a support frame which is pivotally attached to both the boom and the tilt arms of the excavator. One end of the support frame carries a scraper blade that can be used for leveling soil prior to compaction. A drum frame is connected to the support frame and a compaction drum is mounted for rotation on the drum frame. To vibrate the drum, an exciter is mounted on the drum frame and resilient isolation mounts interconnect the support frame and the drum frame to minimize the transmission of vibration to the support frame.

12 Claims, 2 Drawing Sheets

FIG. 3
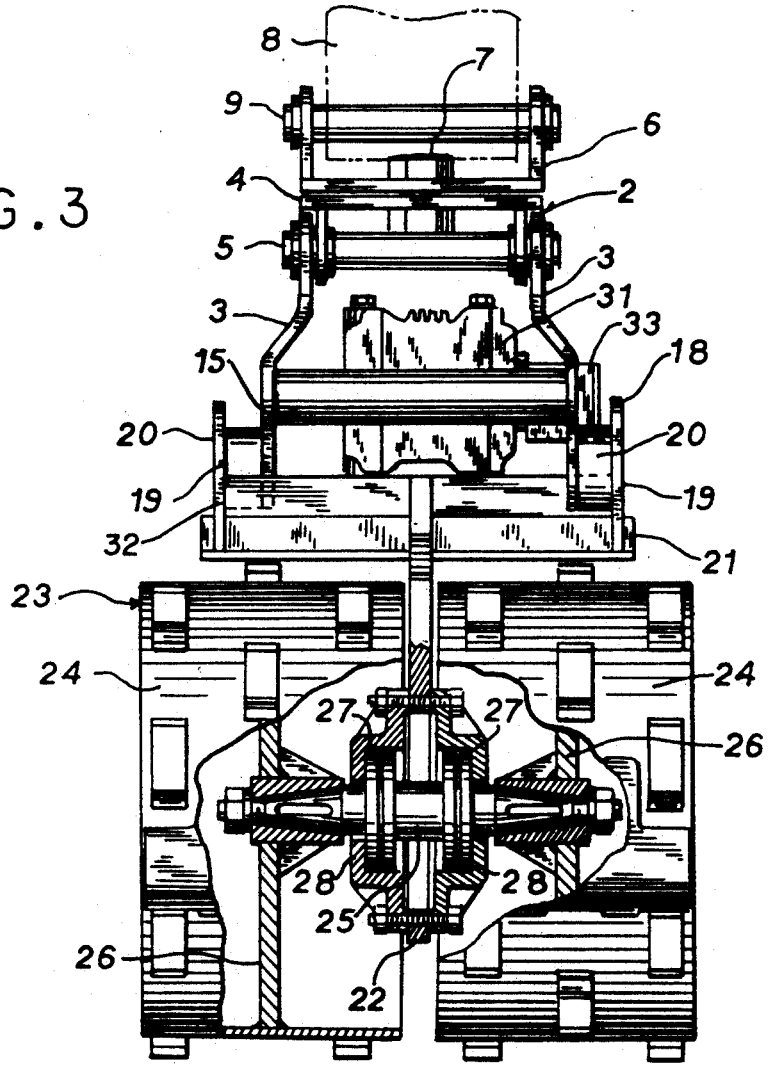
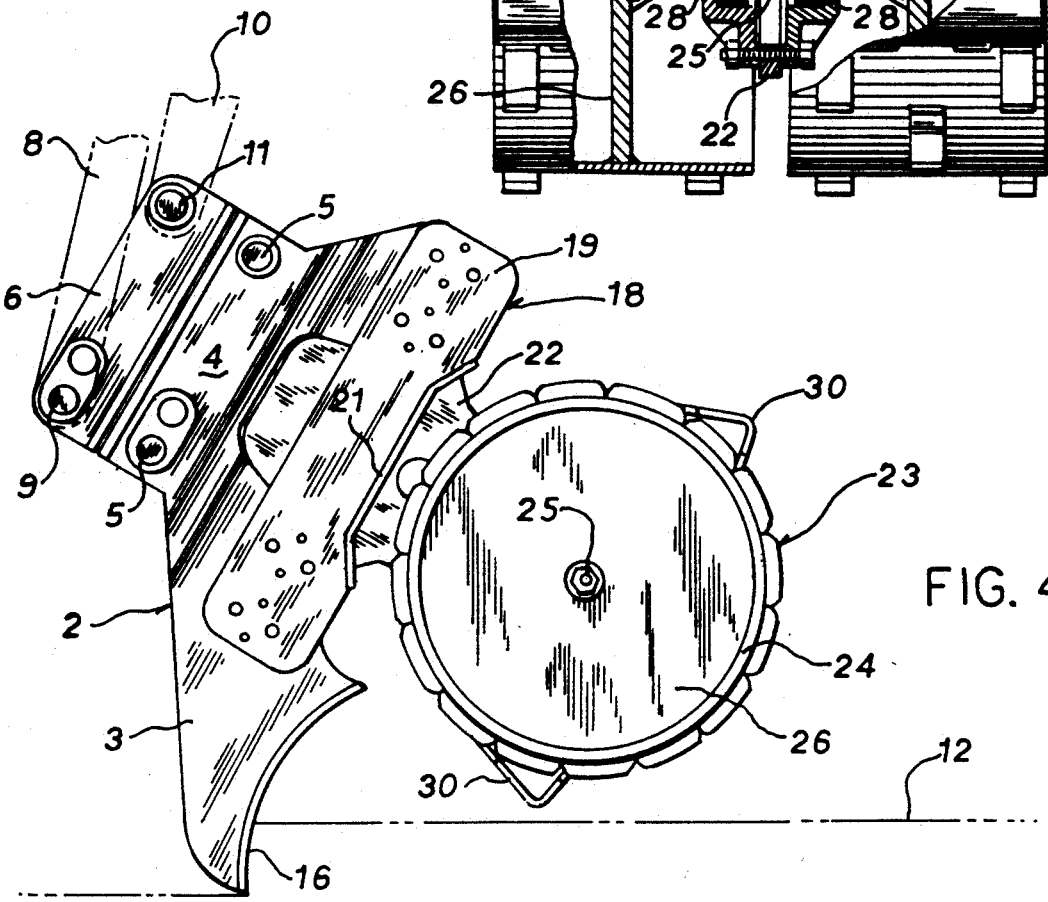
FIG. 4

VIBRATORY COMPACTOR ATTACHMENT FOR MECHANICAL EQUIPMENT

Background of the Invention

To compact soil in a trench or other narrow excavation, it has been common practice to use a manual walk-behind compactor. If the trench is deep, there is a potential danger to the operator of the compactor due to possible cave-in of the trench. Further, the use of a walk behind compactor is relatively slow and as the compactor is manually manipulated, it is limited in size and weight and therefore does not have great compacting capacity.

To increase the compacting capacity when compacting soil in a trench, it has been proposed to combine a compaction drum with the boom of a backhoe or other excavating device. In this construction, the drum is mounted for rotation on the boom and through pivotal movement of the boom, the drum can be moved or translated through the trench. Compaction of the soil is achieved by down pressure, so that the entire weight of the machine can be applied to the compaction drum for compaction.

While a boom mounted compaction drum as used in the past greatly increases the compaction capacity over manually operated compactors, it has certain disadvantages. Down pressure compaction is effective for non-granular materials, such as clay-type soil, but is not particularly effective for use in granular material, such as sand or gravel. Further, as the compaction force is achieved by down pressure, the operator must exert extreme caution that excessive force is not utilized which could possibly crush a pipe buried in a trench. As a further disadvantage, the typical boom mounted compaction drum is fixed in orientation relative to the boom of the excavating machine and there is no provision for pivoting the drum relative to the boom. This restricts the use of the compaction drum in certain applications.

Summary of the Invention

The invention is directed to a vibratory compaction attachment for mechanical equipment and has particular application for attachment to an excavator or backhoe.

The attachment includes a support frame and the boom, as well as the tilt arms of the back hoe are pivotally connected to the support frame. The attachment also includes a drum frame which is connected to the support frame, and a compaction drum is mounted for rotation on the drum frame. To provide vibratory motion for the drum, a vibratory unit or exciter, which can be driven by a hydraulic motor, is mounted on the drum frame. In order to prevent vibration from being transmitted from the drum frame to the support frame, a series of resilient isolation mounts interconnect the two frames.

With this construction, compaction can be achieved by vibration as well as down pressure of the machine acting through the boom. Therefore, in situations where there are no buried pipe in the trench, the compaction force can be increased by utilizing the down pressure of the machine. In other situations where there may be buried pipe, or other objects, in the trench, down pressure can be reduced to prevent crushing of the pipe and the compaction is achieved primarily by the vibratory motion.

As a feature of the invention, a scraper blade is integrally connected with the support frame and by tilting the attachment through operation of the tilt arms, the blade can be moved to a level beneath the compaction drum. Through operation of the boom, the scraper blade can then be used to level the soil in the trench prior to compaction.

A provision is also included in the invention to change or adjust the orientation of the vibratory compaction drum with respect to the excavating machine. In this regard, the support frame includes an upper section which is pivotally connected to the boom and tilt arms of the excavator, and a lower section which is mounted to swivel or rotate relative to the upper section. The two frame sections can be locked together by bolts or other locking mechanism. To change the orientation of the compaction drum relative to the excavating machine, the bolts or locking mechanism is loosened and the lower frame section, along with the compaction drum, can then be pivoted to the desired orientation and locked in that position. By enabling the compaction drum to be changed in angularity or orientation with respect to the machine, the versatility of the attachment is substantially increased.

Other objects and advantages will appear in the course of the following description.

DESCRIPTION OF THE DRAWINGS

The drawings illustrate the best mode presently contemplated of carrying out the invention.

In the drawings:

FIG. 3 is an end view of the attachment with parts broken in section; and

FIG. 4 is a view similar to FIG. 2 showing the scraper blade in the scraping position.

DESCRIPTION OF THE ILLUSTRATED EMBODIMENT

Figure 1:
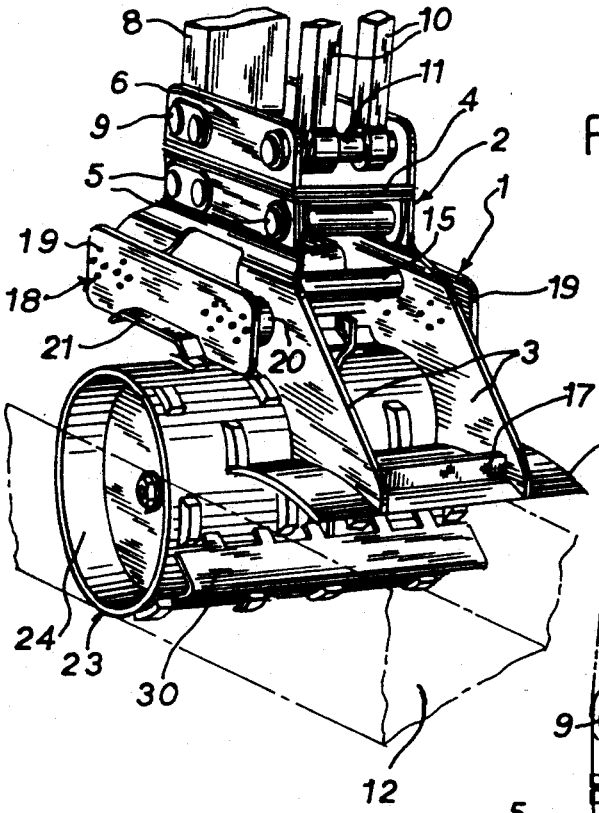
FIG. 1 is a perspective view of the vibratory compaction attachment as connected to a backhoe.
Figure 2:
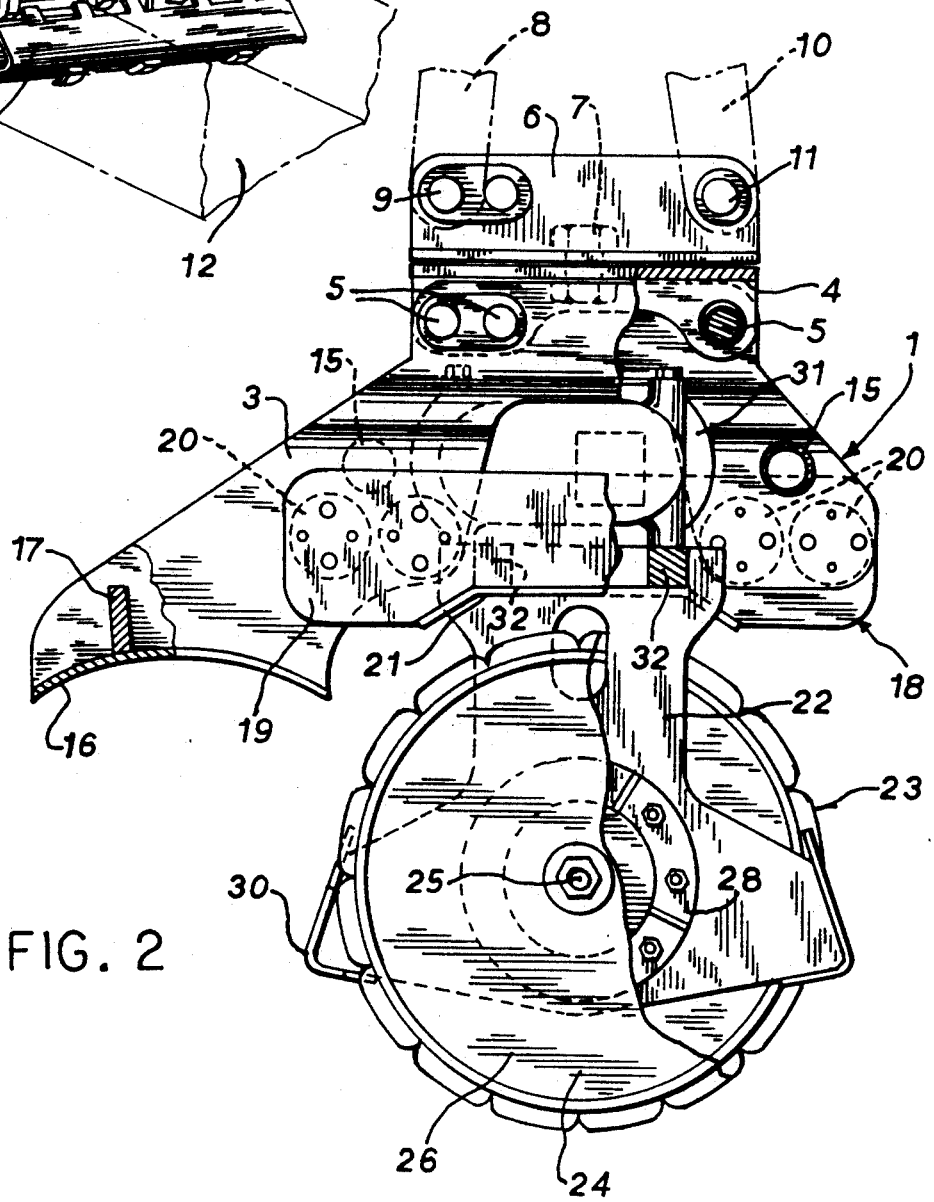
FIG. 2 is a side elevation of the attachment.

The drawings illustrate a vibratory compactor attachment 1 to be used in conjunction with mechanical equipment such as an excavator or backhoe. The attachment has particular application for compacting soil or other materials in a trench or other narrow excavation.

Attachment 1 includes an upper support frame 2 having a pair of side plates 3. The upper edges of side plates 3 are pivotally connected to the depending flanges of channel 4 by shaft 5.

Lower channel 4, in turn, is connected to an upper channel 6 by a central vertical bolt 7 which extends through aligned holes in the webs of the channels.

The lower end of a boom or lift arm 8 of the excavating machine is pivotally connected to the upstanding flange of channel 6 by shaft 9, while a pair of links or tilt arms 10 are pivotally connected to the flanges of channel 6 through shaft 11. The upper ends of links 10 are pivoted to the lower end of a piston rod 13 that is slidable relative to hydraulic cylinder. The upper end of the cylinder is pivotally connected to boom 8.

With this construction, pivotal movement of boom 8 will cause the attachment 1 to move or translate within a trench 12, while operation of cylinder will pivot the attachment about the axis of shaft 9. In addition, by loosening bolt 7, the lower channel 4 and side plates 3 can be rotated relative to the upper channel 6 to thereby change the orientation of the compaction drum relative to the excavating machine, as will be hereinafter described.

Side plates 3 are connected together by a pair of reinforcing tubes 15, and as best shown in FIG. 1, the corresponding ends of plates 3 are connected to a generally curved scraper blade 16. Reinforcing rib 17 extends upwardly from blade 16 and is connected to the plates 3. Through operation of cylinder 14, the attachment 1 can be pivoted to thereby move blade 16 into or out of contact with the soil or other material which is to be leveled and compacted.

Connected to support frame 2 is a drum frame 18, which includes a pair of side plates 19. Side plates 19 of drum frame 18 are connected to side plates 3 of support frame 2 by a plurality of resilient isolation mounts 20. The isolation mounts each include a generally cylindrical resilient pad made of rubber or rubber-like material and a plurality of connecting bolts extend through the pads and connect the plates 3 and 19.

Drum frame 18 also includes a generally horizontal cross plate 21 that is secured to side plates 19, and a central vertical plate 22 is welded to plate 21 and extends downwardly and carries a compaction drum 23.

As best illustrated in FIG. 3, drum 23 includes 4 a pair of cylindrical drum sections 24 which are mounted on either side of plate 22. To mount the drum for rotation, a shaft 25 extends through an opening in plate 22 and each end of the shaft is connected to an internal wall 26 of the respective drum section 24, as shown in FIG. 3. Shaft 25 is journaled for rotation in bearings 27 which are mounted in castings 28 that are secured to plate 22, as shown in FIG. 3. Drum 23 is not driven, but is freely rotatable relative to the drum frame 18 and will rotate in the trench in accordance with pivotal movement of the boom 8 of the excavating machine.

Suitable scraper bars 30 can be mounted on the ends of the plate 22 and are located in close proximity to the peripheral surface of drum 23. Scraper bars 30 act in a conventional manner to scrape mud, or other material, which may adhere to the drum surface.

To vibrate the drum 23 a vibratory unit or exciter 31 is mounted on a pair of beams 32 which extend between side plates 19 of drum frame 18. Exciter 31 is actuated by a hydraulic motor 33, which is operably connected to the exciter as shown in FIG. 3.

The vibratory compactor attachment of the invention has particular use in compacting soil in trenches. If the bottom of the trench is uneven, due to fill having been dumped into the trench, the tilt arm cylinder can be operated to move the scraper blade 16 to a level beneath the lower extremity of compaction drum 23, as shown in FIG. 4. Then, by pivotal movement of boom 8, the blade 16 can be moved within the trench to level the fill.

To compact the soil within the trench, the tilt arms 10 are then operated to move the scraper blade 16 to a level above the drum 23, as shown in FIG. 1, and through pivotal movement of the boom 8, the drum 23 can then be moved within the trench 12 to provide compaction. The compaction can be achieved by a combination of vibratory motion and the down pressure of the boom. In situarions where pipe may be embedded within the trench, the operator will use very little down pressure and rely principally on vibration for compaction. Moreover, vibratory compaction is more effective than down procedure when dealing with granular materials, such as sand and gravel.

With the addition of the scraper blade 16, greater versatility is provided for the attachment in that both scraping and compaction can be performed with the same equipment.

As a further advantage, the orientation of the compaction drum and scraper blade 16 can be changed relative to the machine, due to the swivel connection provided by the bolt 7. This again provides greater versatility for the attachment.

Various modes of carrying out the invention are contemplated as being within the scope of the following claims particularly pointing out and distinctly claiming the subject matter which is regarded as the invention.

I claim:

1. A vibratory compaction attachment for mechanical equipment, comprising a first frame having a pair of opposite sides, first mounting means for connecting a lift mechanism to said first frame, second mounting means for connecting a tilt mechanism to said first frame, second frame including a pair of side members each disposed adjacent a side of said first frame, said second frame also including a transverse connecting member connecting said side members and disposed beneath said first frame, a compaction drum to engage and compact soil, journaling means for journaling said drum for rotation on said second frame, vibratory means mounted on said second frame for vibrating said drum, and resilient isolation means interconnecting each side of the first frame, with the corresponding side member of the second frame to minimize transmission of vibration from said second frame to said first frame.

2. The attachment of claim 1, wherein said vibratory means is carried by said transverse connecting means.

3. The attachment of claim 2, wherein the sides of said first frame and defined by a pair of spaced side plates, said vibratory means disposed between said side plates.

4. The attachment of claim 1, and including a scraper blade connected to said first frame and disposed to be moved to a level beneath said compaction drum on operation of said tilt mechanism to thereby enable said scraper blade to level the soil.

5. The attachment of claim 1, wherein said journaling means comprises a central plate extending downwardly from said, transverse connecting member, said drum including a pair of cylindrical drum sections, each drum section being journaled on said plate.

6. The attachment of claim 5, wherein said journaling means also includes a shaft mounted for rotation relative to said central plate, said drum sections being secured to said shaft, and bearing means for journaling said shaft relative to said central plate.

7. The attachment of claim 1, wherein said first frame includes an upper frame section and a lower frame section, said first and second mounting means being disposed on said upper frame section and said resilient isolated means interconnecting said lower frame section and said second frame, and swivel means for mounting the lower frame section for rotational movement relative to said upper frame section.

8. The attachment of claim 7, and including locking means for locking the lower frame section against rotation relative to said upper frame section.

9. The attachment of claim 1, wherein said resilient isolation means comprises a plurality of resilient pads.

10. A vibratory compaction attachment for mechanical equipment, comprising a first frame, first mounting means on said first frame for connecting said first frame to a lift mechanism, second mounting means on said first frame for connecting said first frame to a tilt mechanism, a second frame, a compaction drum mounted for rotation on said second frame, vibratory means mounted on said second frame for vibrating said compaction drum, movement of said lift mechanism causing said compaction drum to move across the surface to compact the same, and a scraper blade connected to the first frame and movable on operation of said tilt mechanism from a non-operating position at a level above the lower extremity of said compaction drum to an operating position at a level beneath the lower extremity of said compaction drum.

11. The attachment of claim 10, wherein said second frame includes a central plate and said drum includes a pair of drum sections each mounted on opposite sides of said central plate, and journaling means for journaling each drum section relative to said plate.

12. The attachment of claim 10, and including means for mounting said first and second frames for rotation about a generally vertical axis relative to said first and second mounting means.

* * * * *